United States Patent [19]

Hoyer et al.

[11] Patent Number: 4,810,289

[45] Date of Patent: Mar. 7, 1989

[54] HOT ISOSTATIC PRESSING OF HIGH PERFORMANCE ELECTRICAL COMPONENTS

[75] Inventors: Norman S. Hoyer, Mt. Lebanon; Natraj C. Iyer, Monroeville, both of Pa.

[73] Assignee: Westinghouse Electric Corp., Pittsburgh, Pa.

[21] Appl. No.: 177,274

[22] Filed: Apr. 4, 1988

[51] Int. Cl.[4] ..... C22C 29/12

[52] U.S. Cl. ..... 75/232; 75/240; 75/243; 75/246; 75/247; 419/11; 419/18; 419/19; 419/23; 419/25; 419/31; 419/32; 419/33; 419/38; 419/49; 252/512; 252/514

[58] Field of Search ..... 75/232, 240, 243, 246, 75/247; 419/11, 18, 19, 23, 31, 32, 33, 49, 25, 38; 252/512, 514

[56] References Cited

U.S. PATENT DOCUMENTS

| | | | |
|---|---|---|---|
| 3,960,554 | 6/1976 | Gainer, Jr. | 75/200 |
| 4,028,061 | 6/1977 | Kim et al. | 75/233 |
| 4,092,157 | 5/1978 | Reid et al. | 75/206 |
| 4,137,076 | 1/1979 | Hoyer et al. | 75/241 |
| 4,190,753 | 2/1980 | Gainer | 200/144 B |
| 4,450,204 | 5/1984 | Kim et al. | 428/552 |
| 4,541,985 | 9/1985 | Devillard et al. | 419/11 |
| 4,564,501 | 1/1986 | Goldstein | 419/25 |
| 4,582,585 | 4/1986 | Ray | 419/5 |
| 4,591,482 | 5/1986 | Nyce | 419/38 |
| 4,699,763 | 10/1987 | Sinharoy et al. | 419/11 |
| 4,722,825 | 2/1988 | Goldstein | 419/19 |

*Primary Examiner*—Stephen J. Lechert, Jr.
*Attorney, Agent, or Firm*—Daniel P. Cillo

[57] ABSTRACT

A process of hot isostatic pressing of powders to form electrical contacts is characterized by the steps: (A) mixing powders, 1 in the Drawing, from metal containing powder or metal containing powder plus carbon powder, where at least one of Ag and Cu is present, (B) thermal cleaning treatment of the powder, 2 in the Drawing, (C) granulating the thermally treated powder, 3 in the Drawing, (D) uniaxially pressing the powders without heating, 5 in the Drawing, to provide a compact, (E) placing at least one compact in a pressure-transmitting, pressure-deformable container, 6 in the Drawing, and surrounding each compact with fine particles of a separating material, (F) evacuating air from the container, 7 in the Drawing, (G) sealing the compacts inside the container, 8 in the Drawing, (H) hot isostatic pressing, 9 in the Drawing, the compacts through the pressure transmitting material at a pressure from 352 kg/cm$^2$ to 2,115 kg/cm$^2$ and a temperature from 0.5° C. to 100° C. below the melting point of the lower melting powder constituent, to provide simultaneous hot-pressing and densification of the compacts, (I) gradually cooling and releasing the pressure on compacts, 10 in the Drawing, and (J) separating the compacts from the container, 11 in the Drawing, where there is no heating of the compacts in the process before step (H).

10 Claims, 3 Drawing Sheets

HOT ISOSTATIC PRESSING OF HIGH PERFORMANCE ELECTRICAL COMPONENTS

BACKGROUND OF THE INVENTION

1. Field of the Invention

The present invention relates to improved powder metallurgy techniques which provide fully dense electrical contact members for electrical current applications.

2. Description of the Prior Art

High density electrical contacts are well known. For example, Gainer, in U.S. Pat. No. 3,960,554, teaches mixing a minor amount of copper powder with chromium powder, pressing to form a compact, and vacuum sintering to infiltrate the chromium matrix with copper. Gainer, in U.S. Pat. No. 4,190,753, teaches a similar process, utilizing cold isostatic pressing, with minor amounts of chromium in copper powder. Hoyer et al., in U.S. Pat. No. 4,137,076, teach a contact made from Ag, WC and TiC powders, where the mixture is compacted, and then sintered at 1,260° C. in a reducing atmosphere to shrink the compact. This compact is then melt infiltrated with silver, applied in the form of a slug. Kim e al., in U.S. Pat. No. 4,028,061, teach mixing silver powder with cadmium oxide powder; pressure compacting the mixture; impregnating the compact with a solution of an alkali metal salt sintering aid; heating the impregnated compact to decompose the sintering aid; and then heating up to and holding at 900° C. for sintering, to produce a 99.5% dense contact.

Reid et al., in U.S. Pat. No. 4,092,157, teach mixing silver powder with cadmium oxide powder; pressure compacting the mixture; pre-heating the compact up to and holding at from 750° C. to 850° C. for about 1 hour; and then heating up to and holding at 900° C. This appears to provide compacts of about 94% of theoretical density. This controlled thermal cycle is said to provide fine cadmium oxide distribution with minimum aggregate formation. Kim et al., in U.S. Pat. No. 4,450,204, teach making two layer contacts having a silver backing and a silver-cadmium oxide body. Here, silver powder and cadmium oxide powder are mixed and placed in a die; a mixture of silver oxide, silver acetate, and silver powder is placed in the die over the previous mixture; the material is pressed at up to 3,525 kg/cm$^2$ (50,000 psi); and then the compact is heated up to and held at 900° C.

Nyce, in U.S. Pat. No. 4,591,482, teaches the steps of: mixing metal powders specific to samarium, neodymium, cobalt, nickel, titanium, aluminum, copper, vanadium, and stainless and tool steel component powders, having a particle size below 44 microns diameter; pressing at up to 8,460 kg/cm$^2$ (120,000 psi), to 80% of theoretical density; sintering the compact, in "green" form if self-supporting or in a sealed canister if not, at from 1,100° C. to 1,370° C. in a vacuum furnace, to provide 93% to 95% of theoretical density; pressurization, in the sintering chamber or in a separate chamber, up to 211 kg/cm$^2$ (3,000 psi) at a temperature just under the original sintering temperature, with optional temperature spiking to sintering temperature; and then gradual pressure release while cooling, to provide a compact of 98% to 99.5% theoretical density. Temperature spiking can be used to compensate for the cooling effect of the compact due to introduction of cool pressurizing gas or transfer of the compact to the pressure stage. This low pressure assisted sintering (PAS) process is taught as involving less expensive equipment than hot isostatic pressing (HIP), which involves pressures of from 140 kg/cm$^2$ (2,000 psi) to 2,115 kg/cm$^2$ (30,000 psi) and temperatures of from 900° C. to 1,360°C.

Sinharoy et al., in U.S. Pat. No. 4,699,763, teach silver-graphite fiber contacts also containing up to 3 weight percent of a powdered wetting agent selected from nickel, iron, cobalt, copper, and gold. The process involves mixing the components, including a lubricant, drying, screening, pressing to 1,408 kg/cm$^2$ (20,000 psi), heating between 120° C. and 230° C. in air to remove lubricant, sintering between 800° C. and 925° C. in a reducing atmosphere, repressing at about 7,050 kg/cm (100,000 psi), repeating the sintering step, and repeating the pressing at 7,050 kg/cm$^2$.

All of these methods have various drawbacks in terms of providing electrical contacts having the desired properties of full density, high rupture strength, enhanced metal-metal bond, and enhanced resistance to thermal stress cracking. It is an object of this invention to provide a process that results in electrical contacts having all of these properties.

SUMMARY OF THE INVENTION

With the above object in mind, the present invention resides, generally, in a method of forming a dense metal contact characterized by the steps:

(A) mixing:
- (a) powders selected from class 1 metals consisting of Ag, Cu, and mixtures thereof, with
- (b) powders selected from the class consisting of CdO, W, WC, Co, Cr, Ni, C, and mixtures thereof, where the powder particles have diameters up to approximately 100 microns.

(B) heating the powders in a reducing atmosphere, at a temperature effective to provide an oxide clean surface on the powders, except CdO, and more homogeneous distribution of class 1 metals, (C) granulating the powders to where the powder particles have diameters up to approximately 100 microns, (D) uniaxially pressing the powders without heating to a theoretical density of from 65% to 95%, to provide a compact, (E) placing at least one compact in a pressure-transmitting, pressure-deformable container where the compact contacts a separation material which aids subsequent separation of the compact and the container material, (F) evacuating air from the container, (G) sealing the compacts inside the container, (H) hot isostatic pressing the compacts through the pressure transmitting container, at a pressure between 352 kg/cm$^2$ (5,000 psi) and 2,115 kg/cm$^2$ (30,000 psi) and at a temperature from 0.5° C. to 100° C. below the melting point or decomposition point of the lower melting powder, to provide simultaneous hot-pressing and densification to over 98% of theoretical density, (I) gradually cooling and releasing pressure on the compacts, and (J) separating the compacts from the container.

The term "hot isostatic pressing" is used herein to mean pressing at a temperature substantially over the generally accepted sintering temperature of the lower melting powder involved, so that fusion of the lower melting powder is almost achieved and, where the pressing is from all sides at the same time, usually by a pressurized gaseous medium, as distinguished from mechanical, two-sided, uniaxial pressing. This combination of simultaneous heat and pressure results in the compact achieving near full theoretical density, predominantly by plastic flow of the lower melting temperature material.

The process is further characterized in that the powders can be contacted with a brazeable metal material prior to uniaxial pressing. This process involves six basic steps: mixing, oxide cleaning, granulating, uniaxial pressing, hot isostatic pressing, and cooling under pressure. Useful powder combinations, by way of example only, include Ag+CdO, Ag+W, Ag+C; Ag+WC; Ag+WC+Co; Ag+WC+Ni; Cu+Cr; Cu+C; and Cu+WC+Co.

BRIEF DESCRIPTION OF THE DRAWING

The invention will become more readily apparent from the following description of preferred embodiments thereof shown, by way of example only, in the accompanying Drawings of which.

DESCRIPTION OF THE PREFERRED EMBODIMENTS

Figure 1:
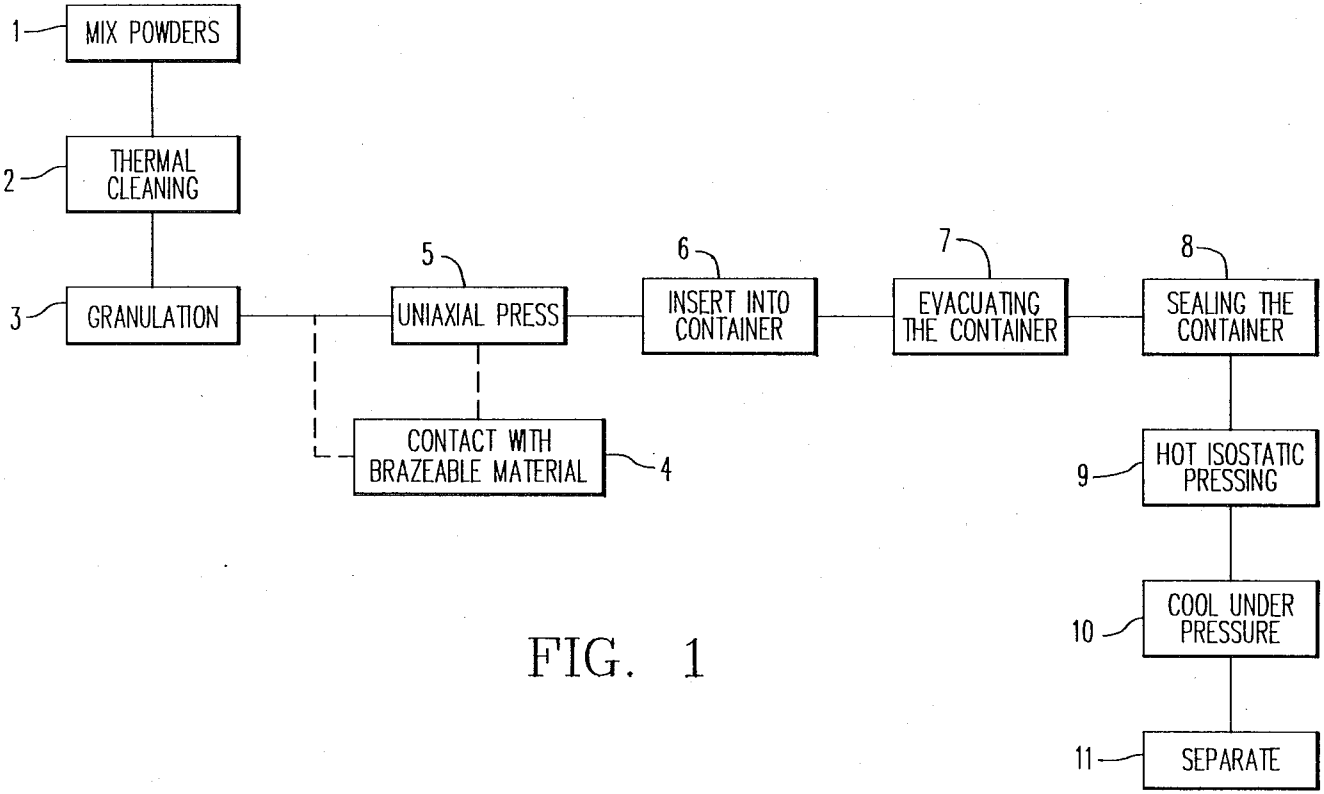
FIG. 1 shows a block diagram of the method of this invention.

Referring now to the Drawing, powders selected from metal containing powder, and metal containing powder plus carbon powder, all having particles of up to approximately 100 microns diameter, preferably in the range of from 0.5 micron to 50 microns diameter, are homogeneously mixed, block 1 of the Drawing. Over 100 microns diameter and high densities are difficult to achieve. Useful powders include two groups of powders: the first is selected from "class 1" metals, defined herein as consisting of Ag, Cu, and mixtures thereof. These are mixed with other powders from the class consisting of CdO, W, WC, Co, Cr, Ni, C, and mixtures thereof. The class 1 powders can constitute from 10 wt. % to 95 wt. % of the powder mixture. Useful mixtures of powders, by way of example only, include Ag+CdO; Ag+W; Ag+C; Ag+WC; Ag+WC+Co; Ag+WC+Ni; Cu+Cr; Cu+C; and Cu+WC+Co.

The mixed powder is then thermally treated to provide relatively clean particle surfaces, block 2 of the Drawing. This usually involves heating the powders at between approximately 450° C., for 95 wt. % Ag+5 wt. % CdO, and 1100° C., for 10 wt. % Cu+90 wt. % W, for about 0.5 hour to 1.5 hours, in a reducing atmosphere, preferably hydrogen gas or dissociated ammonia. This removes oxide from the metal surfaces, yet is at a temperature low enough not to decompose any CdO present. This step has been found important to providing high densification when used in combination with hot isostatic pressing later in the process. Where minor amounts of class 1 powders are used, this step distributes such powders among the other powders, and in all cases provides a homogeneous distribution of class 1 metal powders. The treated particles, which are usually lumped together after thermal oxide cleaning, are then granulated so that the particles are again in the range of from 0.5 micron to 100 microns diameter, block 3 of the Drawing. The mixed powder is then placed in a press die.

Optionally, to provide a brazeable or solderable surface for the contact, a thin strip, porous grid, or the like, of brazeable metal, such as a silver-copper alloy, or powder particles of a brazeable metal, such as silver or copper, is placed above or below the main contact powder mixture in the press die, block 4 of the Drawing.

The material in the press is then uniaxially pressed in a standard fashion, without any heating or sintering, block 5 of the Drawing, at a pressure effective to provide a handleable, "green" compact, usually between 35.2 kg/cm$^2$ (500 psi) and 2,115 kg/cm$^2$ (30,000 psi). This provides a compact that has a density of from 65% to 95% of theoretical.

The compact or a plurality of compacts are then placed in a pressure-transmitting, pressure-deformable, collapsible container, where each compact is surrounded by a material which aids subsequent separation of compact and container material, such as loose particles and/or a coating of ultrafine particles and/or high temperature cloth, block 6 of the Drawing. The air in the container is then evacuated, block 7 of the Drawing, and the container is sealed, usually by welding, block 8 of the Drawing.

The container is usually sheet steel, and the separation material is in the form of, for example, ceramic, such as alumina or boron nitride, or graphite particles, preferably less than about 5 microns diameter, and/or a coating of such particles on the compact of less than about 1 micron diameter. The canned compacts are then placed in an isostatic press chamber, block 9 of the Drawing, where argon or other suitable gas is used as the medium to apply pressure to the container and through the container to the canned compacts.

Pressure in the hot isostatic press step is between 352 kg/cm$^2$ (5,000 psi) and 2,115 kg/cm$^2$ (30,000 psi) preferably between 1,056 kg/cm$^2$ (15,000 psi) and 2,115 kg/cm$^2$ (30,000 psi). Temperature in this step is from 0.5° C. to 100° C., preferably from 0.5° C. to 20° C., below the melting point or decomposition point of the lower melting point powder constituent, to provide simultaneous collapse of the container, and through its contact with the compacts, hot-pressing of the compacts, and densification of the compacts, through the pressure transmitting container, to over 98%, preferably over 99.5%, of theoretical density. Residence time in this step can be from 1 minute to 4 hours, most usually from 5 minutes to 60 minutes. Isostatic presses are well known and commercially available. As an example of this step, where a 90 wt. % Ag+10 wt. % CdO powder mixture is used, the temperature in the isostatic press step will range from about 800° C. to 899.5° C., where the decomposition point of CdO is about 900° C. Controlling the temperature during isostatic pressing is essential in providing a successful process that eliminates the infiltration steps often used in processes to form electrical contacts.

The hot isostatically pressed compact is then gradually brought to room temperature and one atmosphere over an extended period of time, in block 10 of the Drawing, usually 2 hours to 10 hours. This gradual cooling under pressure is very important, particularly if a brazeable layer has been bonded to the compact, as it minimizes residual tensile stress in the component layers and controls warpage due to the differences in thermal expansion characteristics. Finally, the compacts are separated from the container which has collapsed about them, block 11 in the Drawing. Contact compacts made by this method have, for example, enhanced Ag-Ag, Ag-W or Cu-Cr bonds leading to high arc erosion resistance, enhanced thermal stress cracking resistance, and can be made substantially 100% dense. In this process, there is no heating of the pressed compacts before the isostatic hot pressing step.

The following examples further illustrate this invention and is not to be considered in any way limiting.

EXAMPLE 1

A mixture of 90 wt. % Ag powder and 10 wt. % CdO powder, both having particle sizes below about 44 microns diameter, were thoroughly mixed, thermally heat cleaned of oxide at 594° C., and insured of homogeneous Ag distribution, and subsequently granulated in a mill-sieve apparatus to again have particle sizes below about 44 microns diameter. This powder was then placed in a die and uniaxially pressed at 352 kg/Cm$^2$ (5,000 psi) to provide compacts of about 80% of theoretical density. The compacts were 2.54 cm long ×1.27 cm wide ×0.25 cm thick (1 in. ×½ in ×0.1 in.). Twelve of the compacts were placed in a metal can in two rows, with six compacts per row, all surrounded with ceramic particles of about 2 micron diameter, acting as a separation medium.

Air was evacuated from the can using a vacuum pump and then the can was weld sealed. The sealed can was placed in the chamber of an isostatic press, which utilized argon gas under pressure as the medium to apply pressure on the can. Isostatic hot pressing, using a National Forge 2,112 kg/cm$^2$ (30,000 psi) press, was accomplished at a simultaneous 895° C. temperature and 1,056 kg/cm$^2$ (15,000 psi) pressure for about 5 minutes. This temperature was 5° C. below the decomposition temperature of CdO, the lower stable component of the powder mixture. Cooling and depressurizing was then commenced over a 6 hour period. The contacts were removed from the collapsed container and were found to be 98.5% dense, after shrinking 13% during hot-pressing. The macro structure was found to be homogeneous. geneous.

EXAMPLE 2

In a similar fashion, ten contacts made from 35 wt. % Ag+65 wt. % W powders were made, with an 0.025 cm (0.01 in.) thick Ag brazing layer, using the same pressures, but an isostatic press temperature of about 950° C., which was 11° C. below the melting point of Ag, the lower stable component of the powder mixture. The contacts measured 2.54 cm long ×1.1 cm wide ×0.22 cm thick (1.0 in ×0.44 in ×0.09 in). Their properties are listed in Table 1 below, compared to standard Ag-W contacts made by liquid phase infiltration, involving mixing a little of the Ag with W, pressing, and then melting the remaining Ag over the compact to infiltrate the structure.

TABLE 1

| | SAMPLE 1 Standard Ag—W* | SAMPLE 2 Hot Isostatic Pressed Ag—W |
|---|---|---|
| Density gram/cm$^3$ | 14.3–14.6 | 14.8 |

TABLE 1-continued

| | SAMPLE 1 Standard Ag—W* | SAMPLE 2 Hot Isostatic Pressed Ag—W |
|---|---|---|
| % Theoretical Density | 96–98 | 99.4–99.5 |
| Hardness $R_{30}T$ | 64–70 | 73–77 |
| Macro Structure | Occasional Slight Porosity | Homogeneous |

*Comparative Example.

Figure 2A:
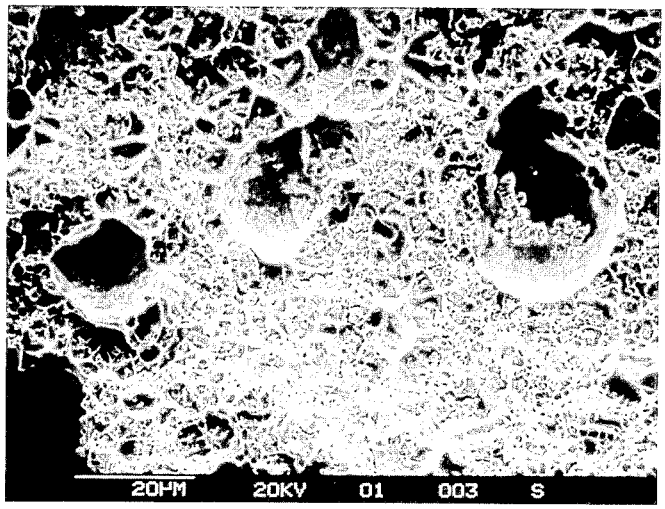
FIGS. 2A and 2B show comparative scanning electron micrographs of deliberately fractured surfaces of two contacts, with FIG. 2B showing general absence of voids in a contact made by the method of this invention.
Figure 2B:
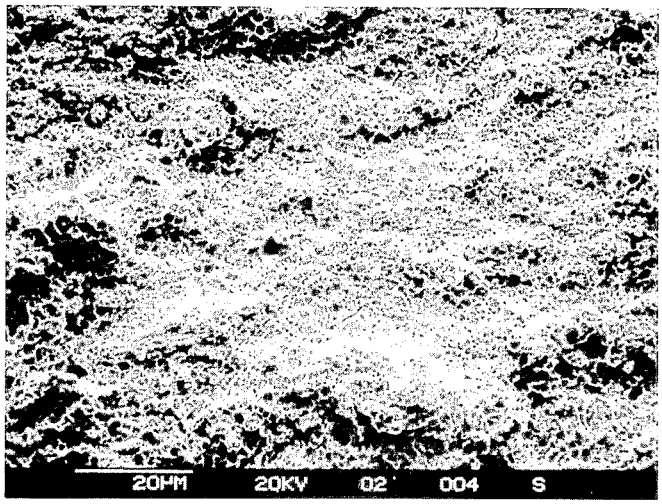

As can be seen, results using the hot isostatic pressing process are excellent. A contact of each sample was fractured and a scanning electron micrograph of a typical fracture surface of each contact was taken. FIG. 2A shows the micrograph of the Standard Sample 1, Ag-W contact. FIG. 2B shows the micrograph of the Sample 2 contact, made by the method of this invention, which shows a general absence of the large pore areas shown in FIG. 2A; i.e., FIG. 2B shows an advantageous homogeneous surface.

Figure 3A:
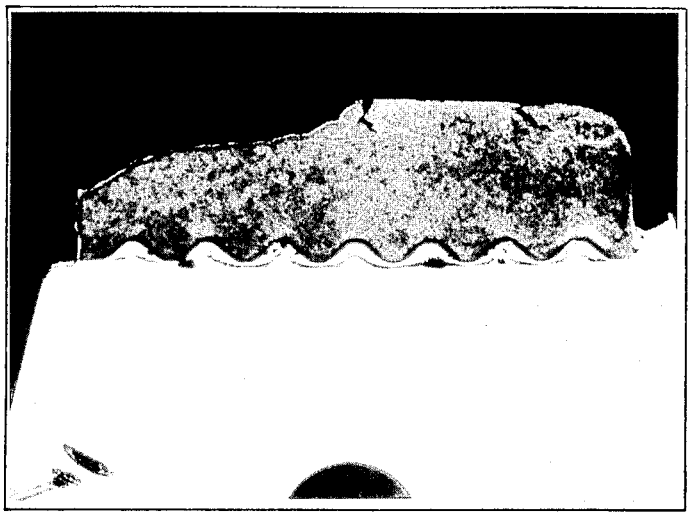
FIGS. 3A and 3B show comparative optical micrographs through a thickness section of contacts subject to short circuit testing, with FIG. 3B showing general freedom of surface cracks for a contact made by the method of this invention.
Figure 3B:
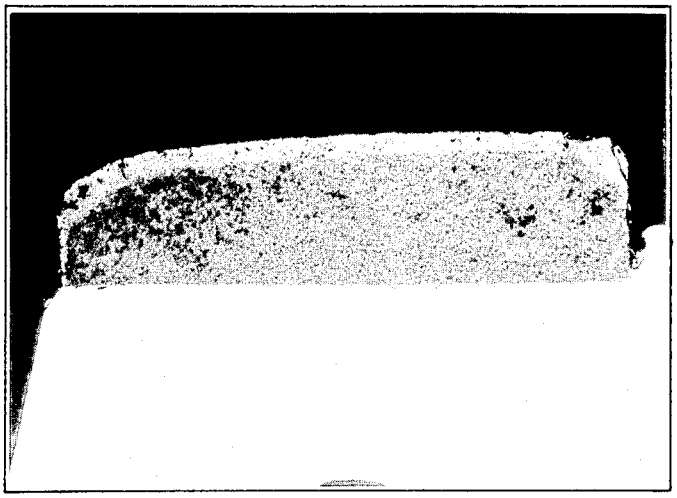

Also, contacts of both Sample 1 and 2 manufacture were mounted and subjected to standard short circuit testing at 600 V. and 10 KA, in a Molded Case circuit breaker. The contacts were then removed and sectioned through their thickness. Optical micrographs were then taken of each. FIG. 3A shows the Sample 1 section which exhibited surface cracks and severe material loss. The bottom of the Sample 1 section of FIG. 3A shows the infiltration serrated area. FIG. 3B shows the Sample 2 contact made by the method of this invention, which exhibited little cracking and much less material loss.

We claim:

1. A method of forming a high density electrical contact comprising the steps:

(A) mixing:

(a) powders from class 1 metals selected from the group consisting of Ag, Cu, and mixtures thereof, with (b) powders from the class selected from the group consisting of CdO, W, WC, Co, Cr, Ni, C, and mixtures thereof, where the powder particles have particle sizes of up to approximately 100 microns diameter;

(B) heating the powders in a reducing atmosphere at a temperature effective to provide an oxide clean surface on the powders, except CdO, and more homogeneous distribution of class 1 metals, (C) granulating the powder from step (B) to again provide powder having particle sizes of up to approximately 100 microns diameter;

(D) uniaxially pressing the powders without heating, to provide a compact that is from 65% to 95% dense, and then (E) placing at least one compact in a pressure-transmitting, pressure-deformable container and surrounding each compact with fine particles of a separating material, which aids subsequent separation of the compact and the container, and then (F) evacuating air from the container, and then (G) sealing the compacts inside the container, and then (H) hot isostatically pressing the compacts through the pressure transmitting container, at a pressure of from 372 kg/cm$^2$ to 2,115 kg/cm$^2$, and a temperature of from 0.5° C. to 100° C. below the melting point or decomposition point of the lower melting powder constituent, to provide simultaneous hot-pressing and densification of the compacts, and then (I) gradually cooling and releasing the pressure on the compacts so that the compacts cool under pressure, to provide a compact at least 98% dense, and then (J) separating the compacts from the container, where, in the process, there is no heating of the compacts before step (H).

2. The method of claim 1, where the powders are contacted with a brazeable metal material prior to step (D).

3. The method of claim 1, where the powders are contacted with a brazeable metal strip prior to step (D).

4. The method of claim 1, where the powders are pressed in step (D) at from 35.2 kg/cm$^2$ to 2,115 kg/cm$^2$

5. The method of claim 1, where the hot isostatic pressing in step (H) is from 1,056 kg/cm$^2$ to 2,115 kg/cm$^2$, and the temperature is from 0.5° C. to 20° C. below the melting point or decomposition point of the lower melting powder constituent.

6. The method of claim 1, where the powder is selected from the group consisting of Ag+CdO; Ag+W; Ag+C; Ag+WC; Ag+WC+Co; Ag+WC+Ni; Cu+Cr; Cu+C; and Cu+WC+Co.

7. The method of claim 7, where the powders have a particle size in the range of from 0.5 micron to 50 microns, and they are contacted with a metal strip prior to step (D).

8. The method of claim 1, where thermal treatment in step (B) is in a gas selected from the group consisting of hydrogen gas, and dissociated ammonia.

9. The method of claim 1, where, in step (H), there is simultaneous collapse of the container and its contact with the compacts, hot-pressing, and densification of the compacts to over 99.5% of theoretical density through the pressure transmitting container.

10. A high density contact made by the method of claim 6.

* * * * *

UNITED STATES PATENT AND TRADEMARK OFFICE

CERTIFICATE OF CORRECTION

PATENT NO. : 4,810,289

DATED : Mar. 7, 1989

INVENTOR(S) : Norman S. Hoyer, et al.

It is certified that error appears in the above-identified patent and that said Letters Patent is hereby corrected as shown below:

On the title page item [75], add --Alan T. Male, Murrysville, Pa.--

Signed and Sealed this

Twenty-second Day of January, 1991

*Attest:*

HARRY F. MANBECK, JR.

*Attesting Officer*

*Commissioner of Patents and Trademarks*